US006155693A

United States Patent [19]

Spiegel et al.

[11] Patent Number: 6,155,693

[45] Date of Patent: Dec. 5, 2000

[54] LIGHTING FITTING WITH A BASIC UNIT AS SUPPORT FOR AT LEAST ONE LAMP

[75] Inventors: Michael Spiegel, Dornbirn; Wolfgang Keckeis, Rankwell, both of Austria

[73] Assignee: Zumtobel Staff GmbH, Dornbirn, Austria

[21] Appl. No.: 09/194,014

[22] PCT Filed: May 15, 1997

[86] PCT No.: PCT/EP97/02509

§ 371 Date: May 13, 1999

§ 102(e) Date: May 13, 1999

[87] PCT Pub. No.: WO97/44616

PCT Pub. Date: Nov. 27, 1997

[30] Foreign Application Priority Data

May 20, 1996 [DE] Germany ..... 196 20 209

[51] Int. Cl.[7] ..... F21S 1/02

[52] U.S. Cl. ..... 362/147; 362/217; 362/368

[58] Field of Search ..... 362/147, 217, 362/223, 225, 368

[56] References Cited

U.S. PATENT DOCUMENTS

| | | | |
|---|---|---|---|
| 2,274,612 | 2/1942 | Johnston . | |
| 2,401,634 | 6/1946 | Gubin . | |
| 2,740,883 | 4/1956 | Kruger . | |
| 2,759,094 | 8/1956 | Goddard et al. . | |
| 3,792,247 | 2/1974 | Beuttell | 362/225 |
| 4,225,905 | 9/1980 | Moriyama et al. | 362/225 |
| 4,814,958 | 3/1989 | Hsieh . | |
| 5,521,801 | 5/1996 | Pesau et al. | 362/217 |

FOREIGN PATENT DOCUMENTS

| | | |
|---|---|---|
| 0272681 | 6/1988 | European Pat. Off. . |
| 0315520 | 5/1989 | European Pat. Off. . |
| 0574761 | 12/1993 | European Pat. Off. . |
| 2459940 | 1/1981 | France . |
| 1701606 | 6/1955 | Germany . |
| 17524170 | 3/1957 | Germany . |
| 3704501A1 | 9/1987 | Germany . |
| 8809692 U 1 | 11/1988 | Germany . |
| 8914115 U 1 | 2/1990 | Germany . |
| 4219742A1 | 12/1993 | Germany . |
| 9316102 U 1 | 2/1994 | Germany . |
| 9419055 U 1 | 1/1995 | Germany . |
| 9416878 U 1 | 2/1995 | Germany . |
| 4416109A1 | 11/1995 | Germany . |
| 565974 | 8/1975 | Switzerland . |
| 477560 | 1/1938 | United Kingdom . |

*Primary Examiner*—Thomas M. Sember
*Attorney, Agent, or Firm*—Fitzpatrick, Cella, Harper & Scinto

[57] ABSTRACT

A light fitting (1) has a base body (2) on which can be mounted at least one lamp (23, 91), an operating device (12) and, optionally, reflectors (60). A fastener, which engages the base body directly, is provided for fixing the light fitting to a ceiling (71) or to a wall. The base body is formed with two side body walls (9) which enclose a trough-like space (11); and the fastener is accessible on the side of the base body walls which face the ceiling or the wall.

22 Claims, 10 Drawing Sheets

LIGHTING FITTING WITH A BASIC UNIT AS SUPPORT FOR AT LEAST ONE LAMP

BACKGROUND OF THE INVENTION

1. Field of the Invention

This invention relates to a light fitting and more particularly it concern a novel light fitting base body which provides improved mounting and holding supports.

2. Description of the Related Art

The main purpose of a light fitting, namely to illuminate a room can be assigned various aspects whereby different demands are made of the light fitting depending on the available lighting criteria.

If for example the room is merely to be brightly illuminated, it is sufficient to allocate the light fitting a direct lighting device which beams light into the room. If such a light fitting is to be at least partially anti-glare, then special measures are required to reduce the dazzling effect, at least in certain areas. For this purpose, a plurality of so-called light distributors have already been developed, including reflectors and special measures for reducing glare.

One of these measures can consist in providing the light fitting with a so-called reflector basket which is arranged underneath a lamp and reflects the light reaching it upwards against wing-shaped reflectors which are allocated shaped like wings on both sides of a base body of the light fitting and reflect the light into the room to be illuminated.

A light fitting of the type to which the present invention is applicable is described in EP 0 574 761 A1 which is assigned to the assignee of the subject application. In this known embodiment, the light fitting is formed as a trough light and a recessed light fitting. The base body in the form of a subbase for the reflector basket and the wing-shaped indirect reflectors are fixed to a lighting trough which is inserted into an available orifice in the ceiling and fixed to the ceiling by means of fixing means located on the edge of the installation orifice.

SUMMARY OF THE INVENTION

The invention is based on the problem of designing a light fitting of the type described above such that it can be manufactured more simply and at lower costs.

This problem is solved according to the present invention by means of novel base body having a trough-like space of generally triangular cross-section which is enclosed by two lateral body walls, the trough-like space being larger than an operating device which is arranged therein, and the lateral body walls converging toward and meeting with a flattened mounting surface to which add-on parts may be mounted. The base body is provided with a fastener by which the base body is mounted. In addition, the base body is provided with a lamp holder which is arranged on a side of the base body which faces the fastener.

In the light fitting according to one aspect of the invention, the base body performs a carrying function for the light fitting, with the fixing means engaging it directly. This embodiment allows a usual lighting housing to be omitted whereby not only material and weight but also the structural size and considerable production costs can be reduced. The light fitting according to the invention also has a stable construction because the incorporation of a lighting housing, as is the case in the known embodiment, reduces the stability of the light fitting. The embodiment according to the invention also permits a simple construction because the number of components of the light fitting can be reduced considerably as a result of the direct engagement of the fixing means to the base body.

The light fitting according to claim 2 of the invention is also advantageous for several reasons. For one thing, the base body itself forms a housing for the electric operating means or an operating device, e.g. a fluorescent lamp ballast of the light fitting so that the usual lighting housing can also be omitted and in this way the advantages described above can be achieved. For another thing, the fixing means do not have to engage the base body directly but can also engage the base body via particular add-on pieces. This embodiment also has a simple construction as special holding means for the operating device or the operating means can be omitted.

The problem is also solved by means of a quick fastening connection, such as a plug in connection which is arranged in a corner region on the side of the base body which faces the fastener. This embodiment of the invention leads to a substantial simplification of the light fitting, both in respect of its construction and in respect of its assembly and disassembly. This embodiment of the invention makes it possible to mount the light distribution elements quickly and simply on the light fitting. This is true for both mounting and dismantling. Consequently, this embodiment of the invention also leads to a considerable simplification and reduction in the costs of the light fitting.

On the basis of the initially described demands made of a light fitting, a further object of the invention is to design a light fitting such that it can be adapted to different demands.

This object is achieved by by providing the base body with multiple holders which can mount different light distributing elements.

In this embodiment of the invention, different light distributors can be mounted optionally on the light fitting as parts of a direct lighting device and/or an indirect lighting device. In doing so, light distributors can be considered which are particularly suitable for fulfilling certain demands. An essential advantage of the invention in this regard is that the light distributors do not require any particular adaptation measures for it to be possible to mount them on the light fitting as the relevant holding means on the base body and on the relevant light distributors match each other and thus the light distributors can be mounted at low costs.

The subclaims contain features which further simplify and improve the construction and assembly or disassembly of the light fitting, lead to embodiments which can be produced at reasonable costs, improve both the direct and/or indirect room lighting and the reflection of the light, improve the accessibility to the light fitting and also open up possible variations for the construction of the light fitting.

BRIEF DESCRIPTION OF THE DRAWINGS

In the following, the invention and the advantages achieved thereby will be explained in more detail using the preferred exemplified embodiments and drawings.

DETAILED DESCRIPTION OF THE PREFERRED EMBODIMENTS

Figure 1:
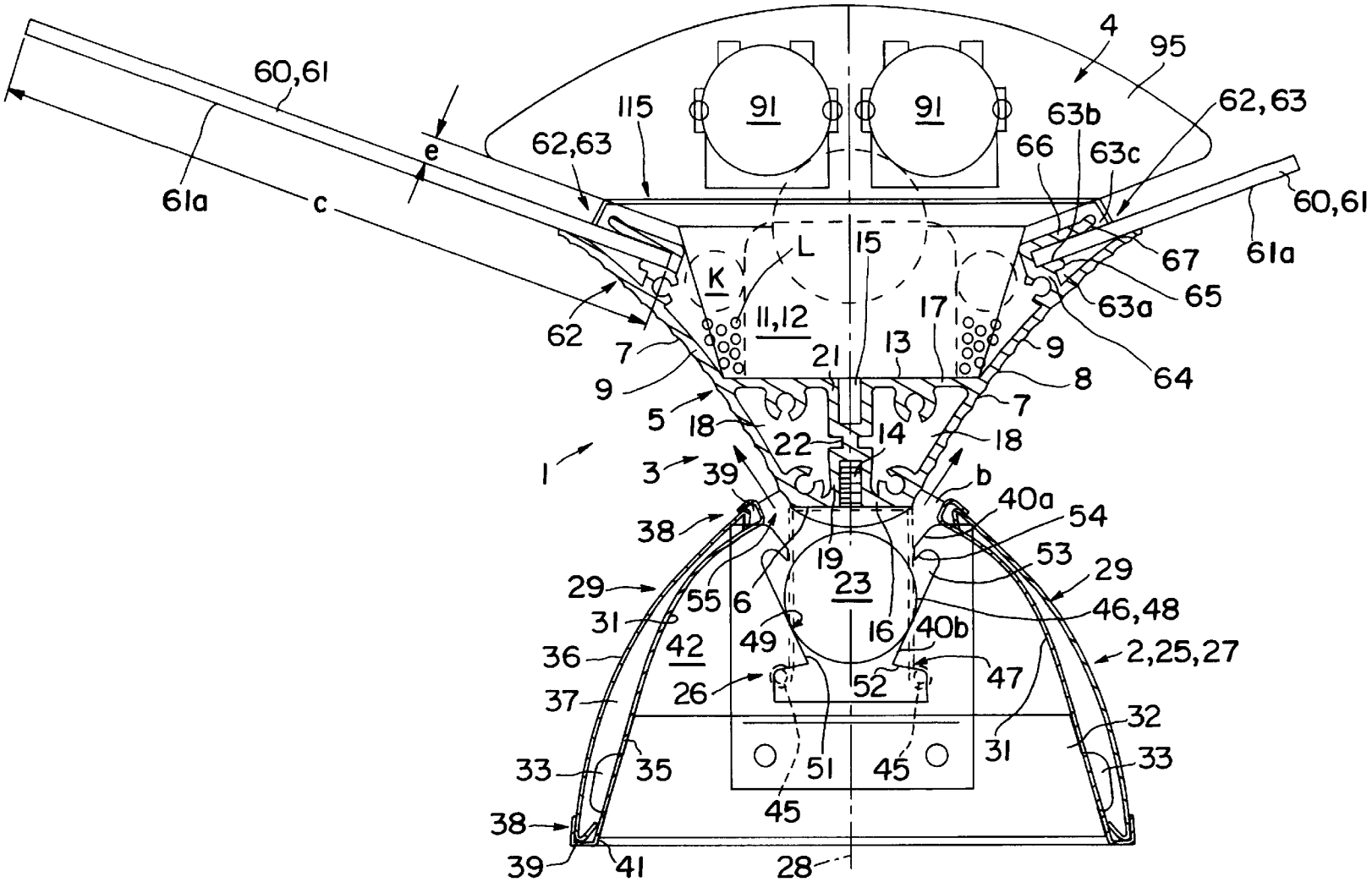
FIG. 1. shows a vertical cross-section of a light fitting according to the invention.

The light fitting according to the invention, referred to with a general 1, is suitable for being fixed to the ceiling of a room to be illuminated either directly or by hanging means. However, it is also possible within the context of the invention to fix the light fitting 1 to a wall, either directly or using spacing means.

This light fitting 1 can be formed with a direct lighting device 2 and/or a first indirect lighting device 3 and/or a second indirect lighting device 4. The direct lighting device 2 and the first indirect lighting device 3 are suitable for direct installation of the light fitting, e.g. to the ceiling. The second indirect lighting device 4 is suitable for a distanced suspension or mounting.

The main part of the light fitting 1 is a base body 5 which extends parallel to the bearer (ceiling, wall), in particular in a straight line, and has a triangular cross-section, with one side of the triangular form being directed upwards (when the light is fixed to the ceiling). The downwards pointing corner of the triangular form can be flattened out horizontally whereby a mounting surface 6 is formed for add-on parts of the base body 5.

The side surfaces 7 of the base body 5 run divergently upwards, wherein they can run in this direction either in a straight line or somewhat concavely rounded. These side surfaces 7 can be smooth or structured. In the present embodiment, they are slightly fluted in the horizontal direction, see the flute tips denoted with 8 which produce the structure with horizontal straight lines 8 on the side surfaces 7.

The vertical cross-section of the base body 5 is V-shaped. That is, the base body 5 comprises the V-shaped side walls 9 containing the side surfaces 7, between which there is an open-topped clearance zone 11 which, in an advantageous and space saving arrangement can serve to accommodate operating means for the light fitting 1, e.g. a fluorescent lamp ballast 12 and such like electric parts for lamps, in particular fluorescent lamps. At the side of this, there is also room in the clearance zone 11 for cables K and/or lines L. In the present embodiment, the bottom surface of the clearance zone 11 is located at approximately mid height of the base body 5 with this bottom surface preferably being a horizontal mounting surface 13 to which the electric connection and/or operating parts such as the fluorescent lamp ballast 12 can be attached. Screw channels 14, 15 are arranged in the lower and the upper mounting surface 6, 13, each being preferably longitudinal and central; these channels 14, 15 serve to attach the add-on parts of the base body 5. It is advantageous for purposes of saving on weight and material to provide a hollow chamber 18 between the bottom walls 16, 17 containing the mounting areas 6, 13. In this embodiment, the screw channels 14, 15 are surrounded by U-shaped wall sections 19, 21 which run through vertically or can be connected to each other by a web 22 by means of which the base body is stabilised.

In this embodiment, the base body 5 is formed by a lengthways extending profile piece, e.g. an extruded profile made of metal, preferably aluminium, or plastic. The profile piece can also be a bent sheet metal part.

The base body 5 is the bearer of the direct lighting device 2 and the first and second indirect lighting devices 3, 4, wherein the direct lighting device 2 or the first indirect lighting device 3 can each be independent devices or in combination. In this case, a lamp 23, preferably formed by a fluorescent tube, arranged under the lower corner region of the triangular form can act as a light source for the direct lighting device 2 and/or the first indirect lighting device 3. The fluorescent tube is mounted between holding parts 24 arranged in the end portions of the light fitting 1 having correspondingly long measurements, which holding parts are arranged on the lower mounting surface 6 and are fixed by means of simply illustrated screws screwed into the relevant screw channel 14 in the manner known per se.

The direct lighting device 2 has a light distributor 25 which is preferably releasably attached to the base body 5 in the lower corner region of the triangular form of the latter, preferably by means of a quick fastening connection or plug in connection, here in the form of a latching device 26.

In the present embodiment, the light distributor 25 is formed by a reflector 27 with two side reflectors 29 arranged on both sides of the lamp 23 mirror inversely to the vertical longitudinal centre plane 28, which side reflectors 29 have concavely curved reflection surfaces 31 for reflecting the light downwards. In the lower area of the side reflectors 29 there are arranged parallel lamellas 32 as known per se underneath the lamp 23 for stopping the direct lighting device 2 from dazzling, which lamellas 32 pass through the reflector walls of the side reflectors 29 in slits with fixing clasps 33 at the ends and are deformed on the outside so that holding together is guaranteed.

It is advantageous to form the side reflectors 29 double-walled with each of them having an inner and an outer wall with the fixing clasps 33 being arranged troublefree in the hollow space 37 which exists between the inner wall 35 and the outer wall 36.

It is also favourable to connect each of the inner and outer walls 35, 36 belonging to each other to one another by means of a quick fastening connection or plug-in connection 38. In the present embodiment, the inner walls 35 are bent outwards in a U-shape in their upper and lower edge areas. As a result, plug recesses 39 are created, into which the affiliated and appropriately wide or high outer wall 36 can be inserted. Here, it is favourable to provide the outer wall 36 with edge limbs 41 along its peripheries, each enclosing an obtuse or acute angle of about 45°, by forming or bending, whereby both the outer wall 36 in question itself and the accommodation in the relevant plug socket is stabilised.

Figure 5A:
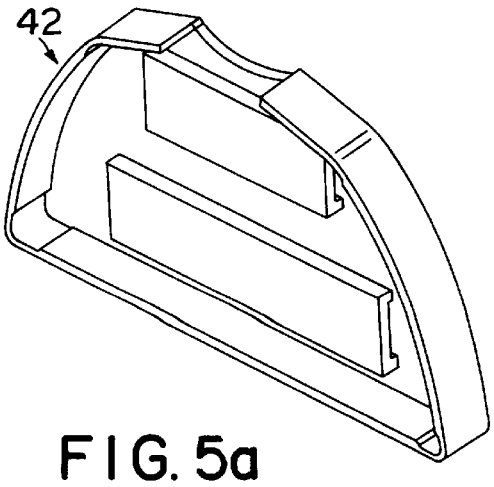
FIG. 5*a* shows a perspective view of an end portion of the light fitting according to FIG. 4 from inside.
Figure 5B:
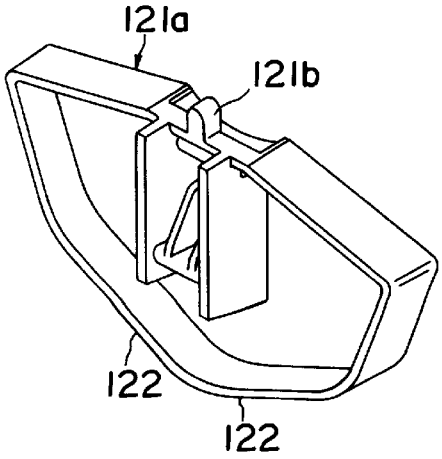
FIG. 5*b* shows an end portion of the light fitting as an exploded view from inside.

On the front side, the reflector 27 is sealed by means of two end caps 42, one of which is illustrated in the perspective inner view in FIG. 5. The end caps 42 can be attached to the side reflectors 29 by fixing elements which, for simplification reasons, are not illustrated.

The side reflectors 29, the inner walls 35, the outer walls 36, the parallel lamellas 32 and the end caps 42 can be made of metal, in particular aluminium, or plastic. These parts can be preferably varnished white, or, particularly in the area of the reflection surfaces, have metallic lustre.

The latching device 26 has one or two opposing elastic latch noses which engage behind a latching edge when it is in the latched position. In this embodiment, two latch noses 45 are provided on either side of the longitudinal centre plane 28 which are arranged on spring arms 46 and can thus yield laterally and preferably yield towards each other and deflect into undercuts 47 when the reflector 27 is connected to the base body 5. In the present embodiment, the latch noses 45 and spring arms 46 are each formed by a U-shaped leaf spring arranged in the end portion and which can engage the lower mounting surface 6 with its web section and is fixed by means of a screw screwed in the relevant screw channel 14, wherein the side limbs thereof form the spring arm 46 and the latch noses 45 can be formed by the free ends of the leaf spring limb being bent out or rolled in. The undercuts 47 are arranged on the sides of a latch bar which face away from each other or—as FIG. 1 shows—on the sides of a latch connecting member 49 which face each other, with the undercuts 47 being ordered before butting slants 51 to which the locking catches 45 yield and then deflect into the undercuts 47 when the reflector 27 is plugged in.

The undercuts 47 preferably comprise execution slants 52 so that the latching can be released by executing a predetermined tensile force on the reflector with the latch noses 45 bending away from their locked position on the execution inclinations 52.

Further undercuts 53 are preferably provided above the undercuts 47 into which the latching noses 45 latch in a suspended position of the reflector 27 in which the manual accessibility to the lower corner region of the base body 5 and components fixed thereto is improved and/or the lighting performance of the direct lighting device 2 and the first indirect lighting device 3 can each be varied contrastingly which will later be described.

The further undercuts 53 are preferably formed with negative latching edges 54 so that no automatic execution of the latch noses 45 from these further undercuts 53 is possible at increased tensile stress. As a result of this, the reflector 27 is safeguarded against unintended removal. Insertion inclinations 40*a,* 40*b* for the latch noses are ordered before the undercuts 47, 53.

Figure 2:
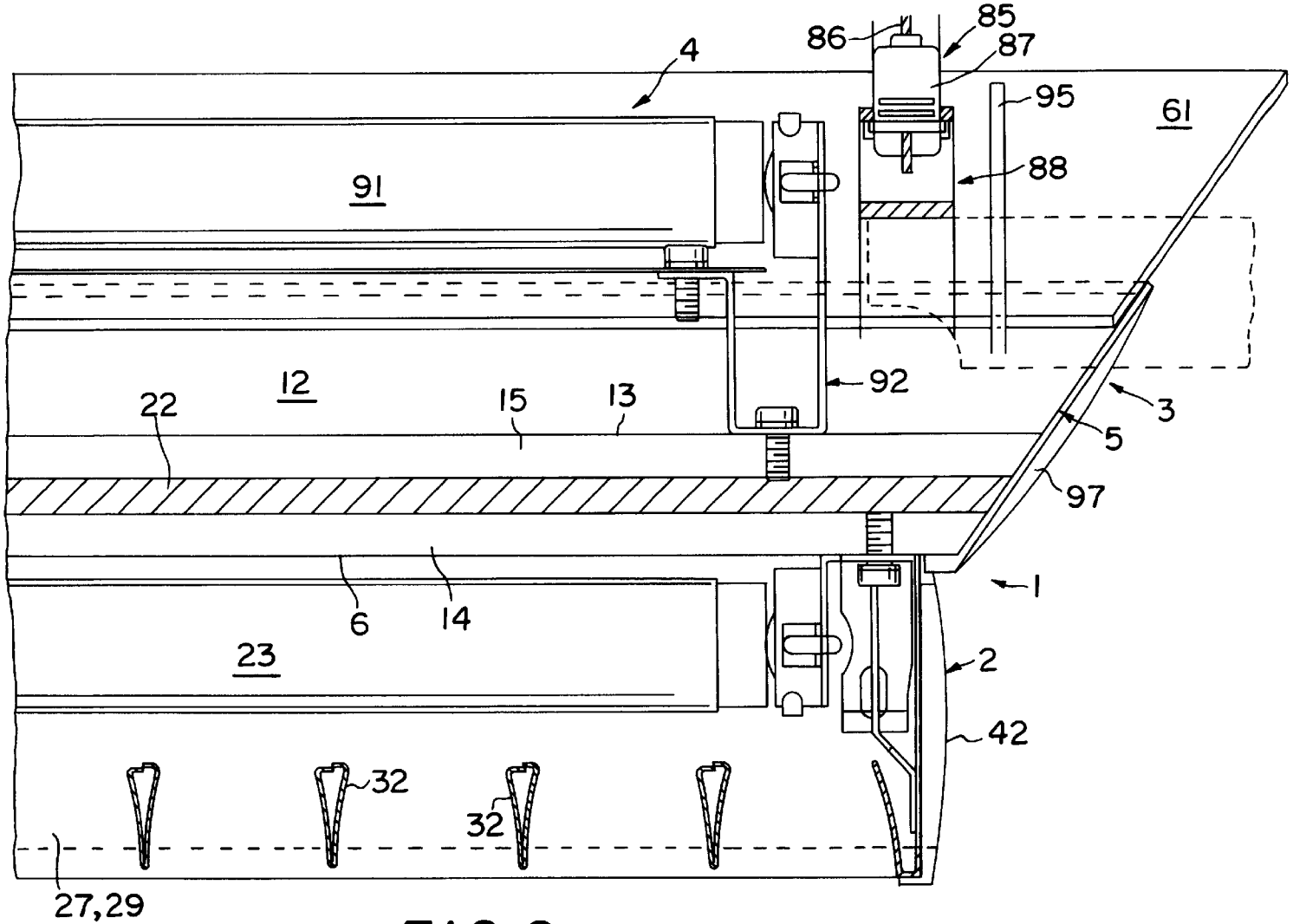
FIG. 2 shows a vertical profile of an end portion of the light fitting.

As can be seen especially from FIG. 2, the (in particular) block-shaped component comprising at least one undercut 47 can be fixed on the inside to the end cap 42, e.g. by screws. In this, it is advantageous to bend this component—seen in the side view—into a Z shape so that its section comprising at least one undercut 47 is at a distance from the end cap 42 and can work better with the latch noses 45 in this position.

It is possible within the framework of the invention to release the light distributor 25 or the reflector 27 in the suspended position on one side from the latched engagement and to pivot it about the other latch nose 45 set in the relevant undercut 53, whereby accessibility is further improved as a result of a greater gap between the light distributor 25 and the base body 5.

The step described above can only be performed if either the lamp 23 is arranged by the suspension measurement deeper than the top ridge area of the reflector 27 or the latter has a recess 55 in its ridge region which is larger in width and length than the width and length of the lamp 23 inclusive of its holding parts so that the lamp 23 is capable of submerging in the recess 55 when it is disconnected.

In the case of a combined direct lighting device 2 and a first indirect lighting device 3, the width is so large that there is a gap b of about 3 to 10 mm, in particular about 5 mm, between the longitudinal edges of the recess 55 and the base body 5 in the lower corner region of the latter through which the light of the lamp 23 can radiate diagonally laterally upwards and illuminate the side area above the light distributor 25 or the reflector 27 whereby the room at hand is indirectly illuminated on both sides of the base body 5.

It is of further advantage to provide lateral or cantilever, flat light distribution elements 61 in the form of flat or thin wing sheets protruding from the two upper corner regions of the base body 5 which are connected to the base body 5 in the latter's upper corner regions in a preferably releasable manner. For this, quick fastening connections are preferably provided to enable light distribution elements 61 of varying widths c and/or varying forms and/or varying lighting characteristics to be alternatively arranged. The light distribution elements 61 could also differ in their extending form and also in their material and design. Several exemplified embodiments will be described in the following. In these, it can be demanded and advantageous for various reasons to arrange the light distribution elements 61 at various alternative inclinations.

A releasable plug-in connection 62 with a plug recess 63 on the base body is very advantageously suitable as a quick fastening connection for the light distribution elements 61, into which plug-in connection 62 the light distribution element 61 can be inserted with low clearance of motion. This guarantees, particularly in the case of an arrangement with the light distribution elements 61 extending laterally and inclining upwards, a secure fit in the respective plug recess 63 so that unintended loosening from the plug recess 63 is out of the question.

To enable the plug recess 63 to be formed in the corner region, the base body 5 and/or its side walls 9 or its section/profile have material shoulders 64 or wall thickenings on the inside in which the plug socket 62 is located.

With a view to arranging the light distribution elements 61 in two different slanted positions, it is advantageous to arrange two plug recesses next to each other or on top of each other at the desired inclination. In doing so, it is particularly advantageous to assign these two plug recesses 63*a,* 63*b* a joint plug opening 63*c* whereby a small or narrow construction is achieved. As the Figures show, the two plug recesses 63*a,* 63*b* are separated or distanced from each other in the region of the recess base by a longitudinal bar 65. The respective longitudinal bar 65 forms mounting surfaces for the light distribution element 61 which stabilise the position of the element. To facilitate the insertion of the light distribution element 61 into the plug opening 63*c,* it is advantageous to provide an insertion bevelling 67 on at least one longitudinal border, in this case at the free end of the wall limb 66 bordering on the upper side of the upper plug recess 63*b*.

The width c of the light distribution elements 61 can differ from arrangement to arrangement. In the case of a light fitting 1 suspended from a ceiling, the width c can be so large that the free ends of the light distribution elements 61 project upwards beyond the light fitting 1.

Figure 4:
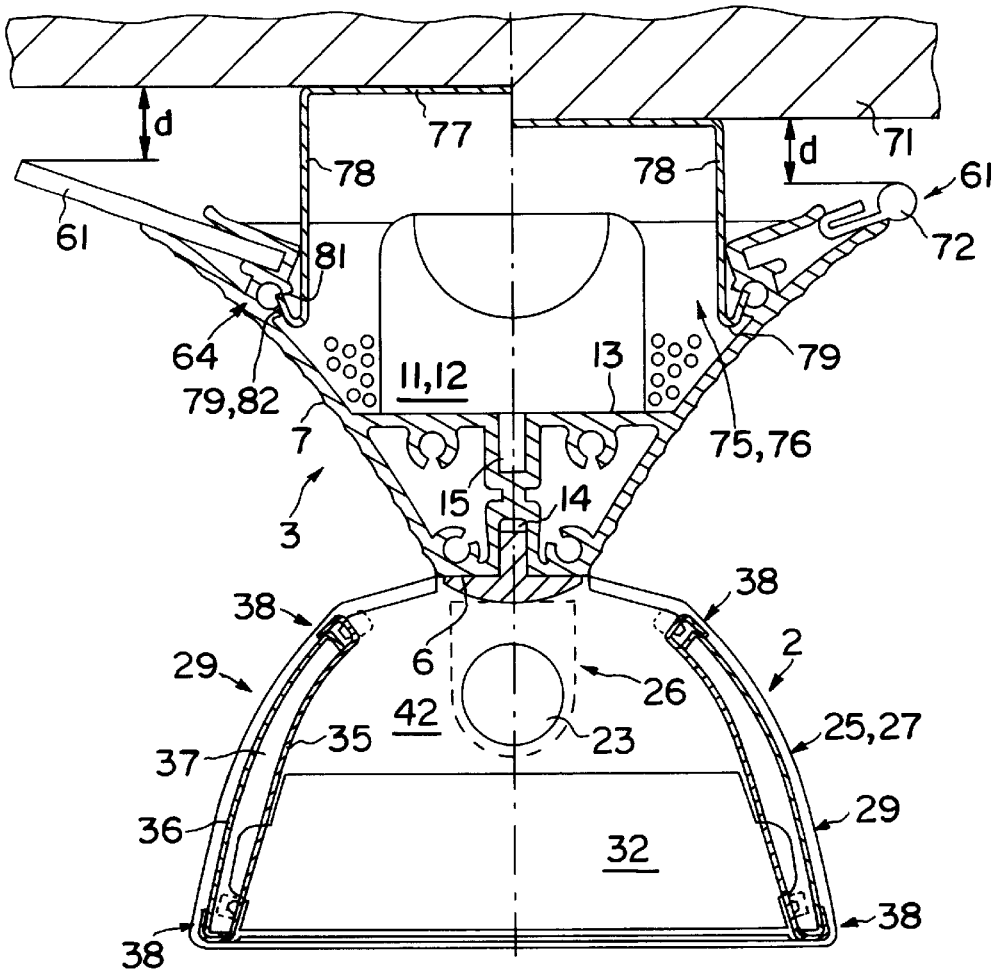
FIG. 4 shows a vertical profile of a light fitting according to the invention in a modified embodiment

In an arrangement where the light fitting 1 is arranged directly or at a small distance from a ceiling 71, the light distribution elements 61 can be omitted or narrow light distribution elements 61 can also be used as is shown in FIG. 4. In this type of arrangement, it is favourable to measure the width b of the light distribution elements 61 such that their free edges end at a gap d from the ceiling 71 (or wall) whereby shading edges are formed which guarantee that the mounted light fitting 1 looks good. In the variation illustrated on the right in FIG. 1, the light distribution element 61 has a cross-sectional circular thickening in the sense of a rim 72 on its free edge, wherein the remaining plug foot of this light distribution element 61 which inserts into the respective plug recess 63*a,* 63*b* or also just into the plug opening 63*c* can be formed or folded U-shaped as is shown in FIG. 4.

FIG. 4 also illustrates a mounting device 75 for attaching the light fitting 1 to the ceiling 71 which is simple and inexpensive to produce and yet functions very well. This mounting device 75 comprises one U-shaped fastening clasp continuous in its length or two or more U-shaped fastening clasps 76 distributed on the longitudinal area of the light fitting 1 with a fixing web 77 for mounting the light fitting 1 on the ceiling 71 with at least one peg (not illustrated) pushing through it in a hole and side limbs 78 running from the fixing web 77 which have locking catches 79 preferably arranged on the outside in the region of their free edges for latching in the catch recesses 81 on the base body 5, preferably in the region of the inner sides of its side walls 9. In this embodiment, the catch recesses 81 are arranged on the inner side of the shoulders 64 with them being parts of the profile piece so that they are formed continuously in the lengthways direction of the base body 5. Therefore, when several fastening clasps 76 are present, the position of these can be arbitrarily selected as the locking catches 79 always fit in the catch recesses 81. In this embodiment, the locking catches 79 are formed by U-shaped edge limbs 82 bent outwards which extend upwards at an angle and thus form insertion inclinations for the locking catches 79. When the base body 5 is inserted onto the fastening clasps 76 from below, the side limbs 78 automatically yield as a result of the insertion bevels and they then deflect automatically into the catch recesses 81. To release this plug-in connection and this latch connection, one of the two side limbs 78 has to bend outwards. This can occur using a pin-shaped tool through the distance d from the relevant side.

To compensate for light distribution elements 61 having different widths b, fastening clasps 76 having side limbs 78 of differing lengths can be optionally provided and can be selected when assembling the light fitting 1. As a result of this, an optimum gap d can be determined despite the available light distribution elements 61 having different sized widths.

A suspension apparatus 85 for suspending a light fitting 1 from a ceiling (not illustrated) in a hanging position is vaguely visible in FIG. 2. The suspension apparatus 85 has a cable 86 (or chain or the like) which can be fixed to the ceiling in the usual manner and which can be connected directly or indirectly to the base body 5 in such a manner that its height can be adjusted. In this embodiment, a cable clamping device 87 which is connected to the base body 5 directly or by means of a connecting part 88 serves this purpose and allows the cable 86 to be securely clamped at the desired height. Either a centrally positioned suspension device 85 or two suspension devices 85 at both sides of the vertical longitudinal centre plane 28 are arranged in each end portion of the light fitting 1.

In this type of suspended arrangement, it is advantageous to provide the second indirect lighting device 4 to illuminate the ceiling area above the light fitting 1 and to thus make the lighting more impressive on the one hand and to achieve indirect illumination in the upper region of the light fitting 1 on the other, which lighting device 4 can be arranged on its own or in addition to the first indirect lighting device 3.

The second indirect lighting device 4 comprises a central or two laterally arranged lamps 91 in the upper region of the base body 5 or above this, which, in this embodiment, are also formed by fluorescent tubes. As shown by FIG. 2, the lamp or the lamps 91 are mounted in holding parts 92 which can, for example, have an angled or U-shaped form and can be arranged on the upper mounting surface 13 and fixed by means of screws 94 screwed into the screw channel 14. To conceal the front ends of the lamps 91, it is favourable to arrange a screen 95 in the end portion of the light fitting 1 and to fix it to the base body 5 as is inferred by FIGS. 1 and 2. The screen 95 does not just cover the lamps 91 on the front side but also the suspension device 85. It can extend over the entire width of the base body 5 or beyond, wherein, in the latter case, it is favourable to adapt its side borders to the shape and/or the incline of the light distribution elements 61 and wherein a gap e can be arranged between the two. In the embodiment according to FIG. 1, the screen, arranged, for example, vertically is convexly rounded at its upper free edge, as a result of which it acquires a mushroom like shape. It can, however, also have other forms. The screen 95 can be inserted into a plug-in connection or connecting member of the base body 5 from above by means of a central web, wherein it can extend vertically or diagonally outwards.

Figure 3A:
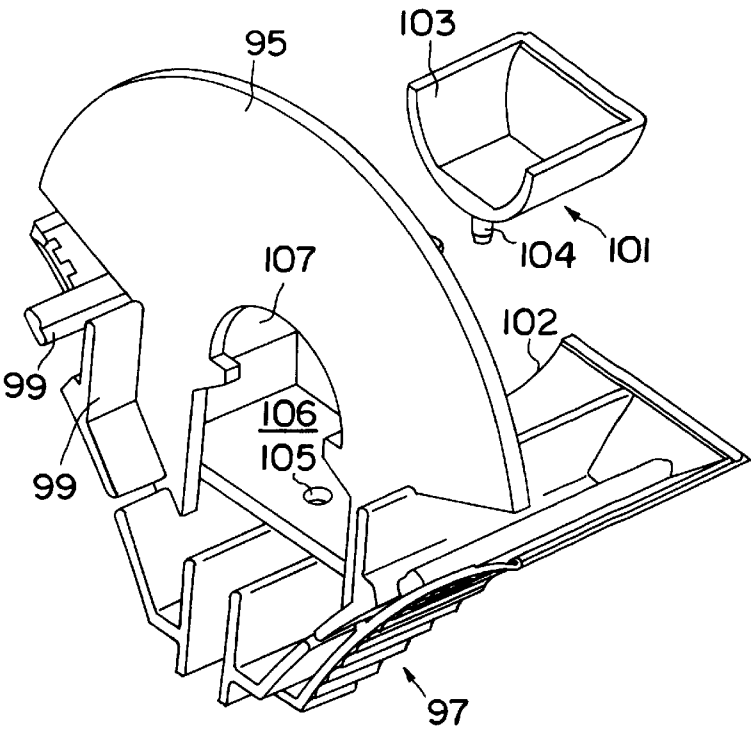
FIG. 3*a* shows a perspective view of an end portion of the light fitting from inside.
Figure 3B:
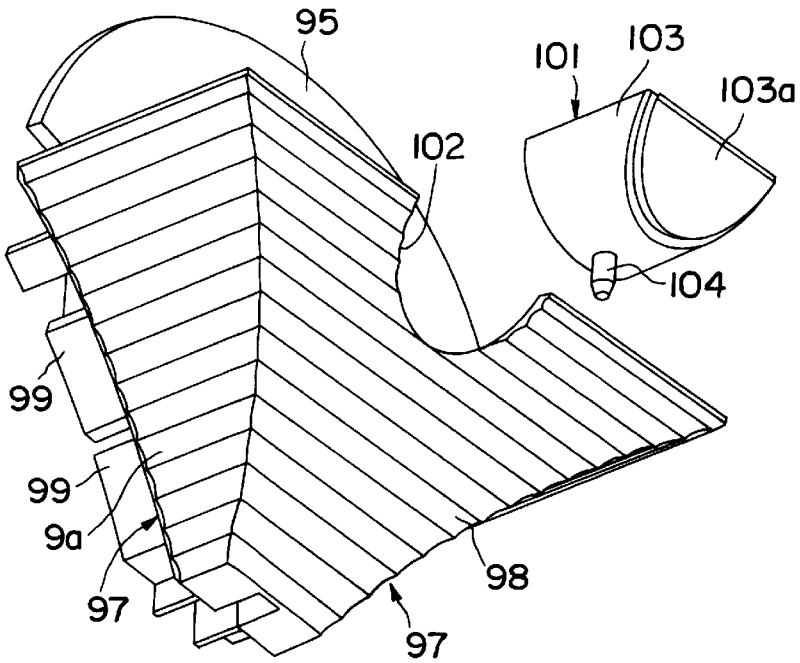
FIG. 3*b* shows a perspective view of the end portion from outside.

The base body 5 is covered by a frontal shield on its front side which can for example be a metal sheet or a thin plate on the front face which can be connected to the base body 5 by a quick fastening connection or preferably a plug-in connection. FIG. 3*a* and FIG. 3*b* each illustrate a frontal cap 97, the front face or front wall 98 of which extends vertically or divergently upwards, as a result of which it has extended side walls 9*a* which, maybe with the front wall 98, correspond to the contours and the structure of the side surfaces 7. The frontal cap 97 has projecting insertion spigots 99 on its side facing the base body 5, with which it can be inserted and clamped or latched into matching plug recesses of the base body 5 whereby it is mounted on the base body 5.

As shown by FIG. 3, the screen 95 can be formed as one piece on the frontal cap 97. 101 denotes in each case a filling piece with which a prefabricated through hole 102 in the upper region of the front wall 98 can be filled out, which hole acts, if need be, as the passage for electrical lines, for example, in an arrangement of several light fittings 1 in the form of a light band. In this embodiment, the filling piece 101 is formed in the form of a trough 103 with a front wall 103*a* on its free end which can lock with the front wall 98 when the filling piece 101 is in its inserted position. To fix the filling piece 101, a joggle joint is provided, here with a peg 104 pointing downwards from the filling piece 101 which can be inserted into a notch 105 in an approximately horizontal intermediate wall 106 onto which the filling piece 101 can be placed. In the inserted position, the filling piece 101 locks with the upper edge of the frontal cap 97. 107 denotes a through hole in the screen 95 for cables K and/or lines L. A pipe 101*a,* indicated with dotted lines in FIG. 2, and which penetrates the front wall 97 at least partially can also act as a cable duct.

In a diverging arrangement of the front wall 98 of the base body 5 or the frontal cap 97, it is advantageous to form the light distribution elements so that they diverge towards their outer borders so that—as can be seen from FIG. 2—the diagonal front edges of the light distribution elements 61 are arranged in approximate alignment with the diverging or diagonal front wall 98.

The light fitting 1 is formed mirror inversely in its front facing end portions. Therefore, no further description of the other end portion of the light fitting 1 is required.

Figure 6:
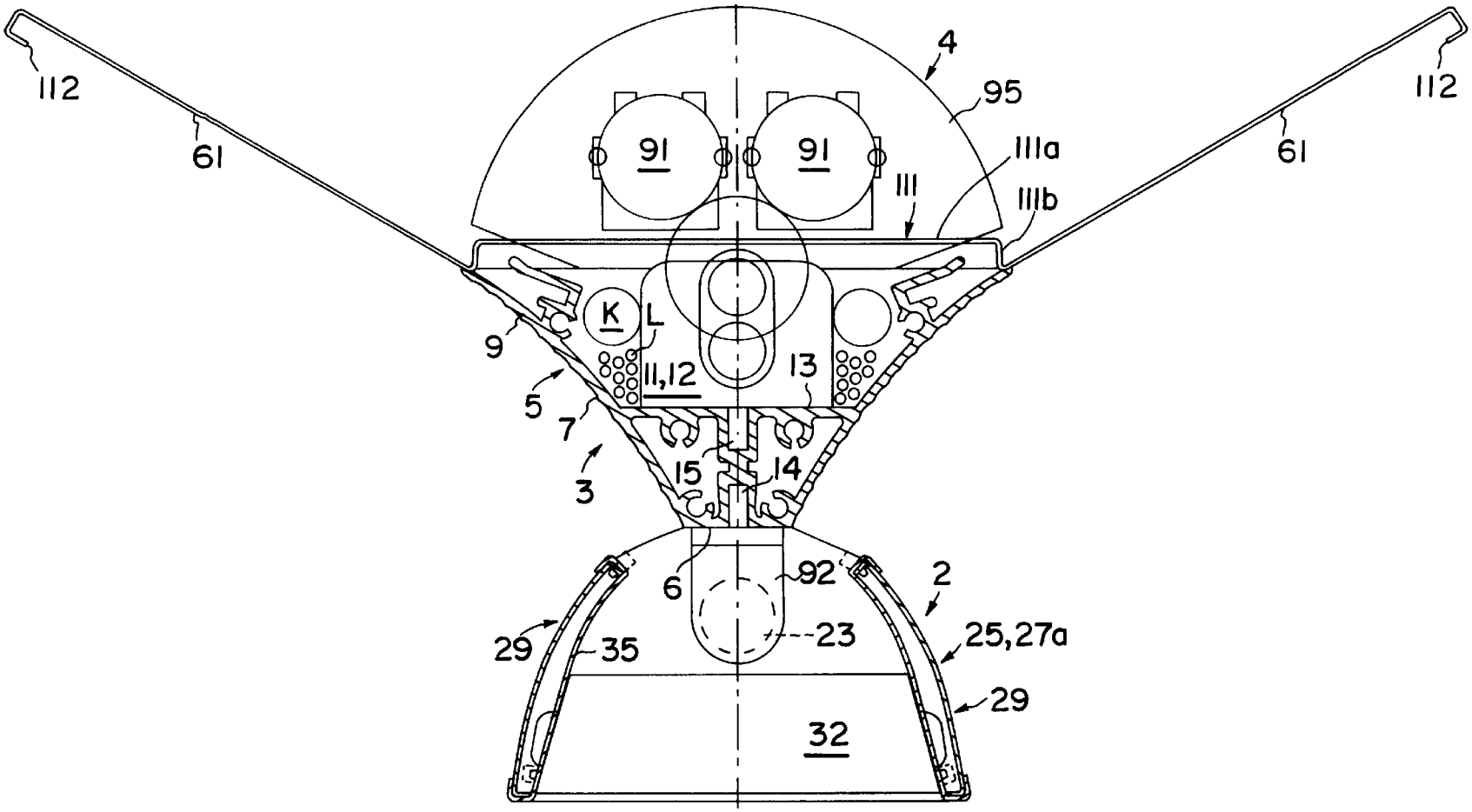
FIG. 6 shows a vertical profile of a light fitting according to the invention in a modified embodiment.

In the embodiment according to FIG. 6, in which identical or similar parts are given the same reference numbers, the wing-like light distribution elements 61 are preferably connected in one piece by at least one cross-connection portion 111, which can span the length between the base body 5 and the lamp(s) 91 or extends at the ends next to them. In the embodiment according to FIG. 6, the cross-connection portion 111 is made up of a horizontally extending cross-connection web 111*a* and cross-connection limbs 111*b* bent downwards at the sides of said web, to which limbs the light distribution elements 61 are integrally connected. As a result of this form, the cross connection portion 111 can be advantageously integrated into the available construction.

Figure 8:
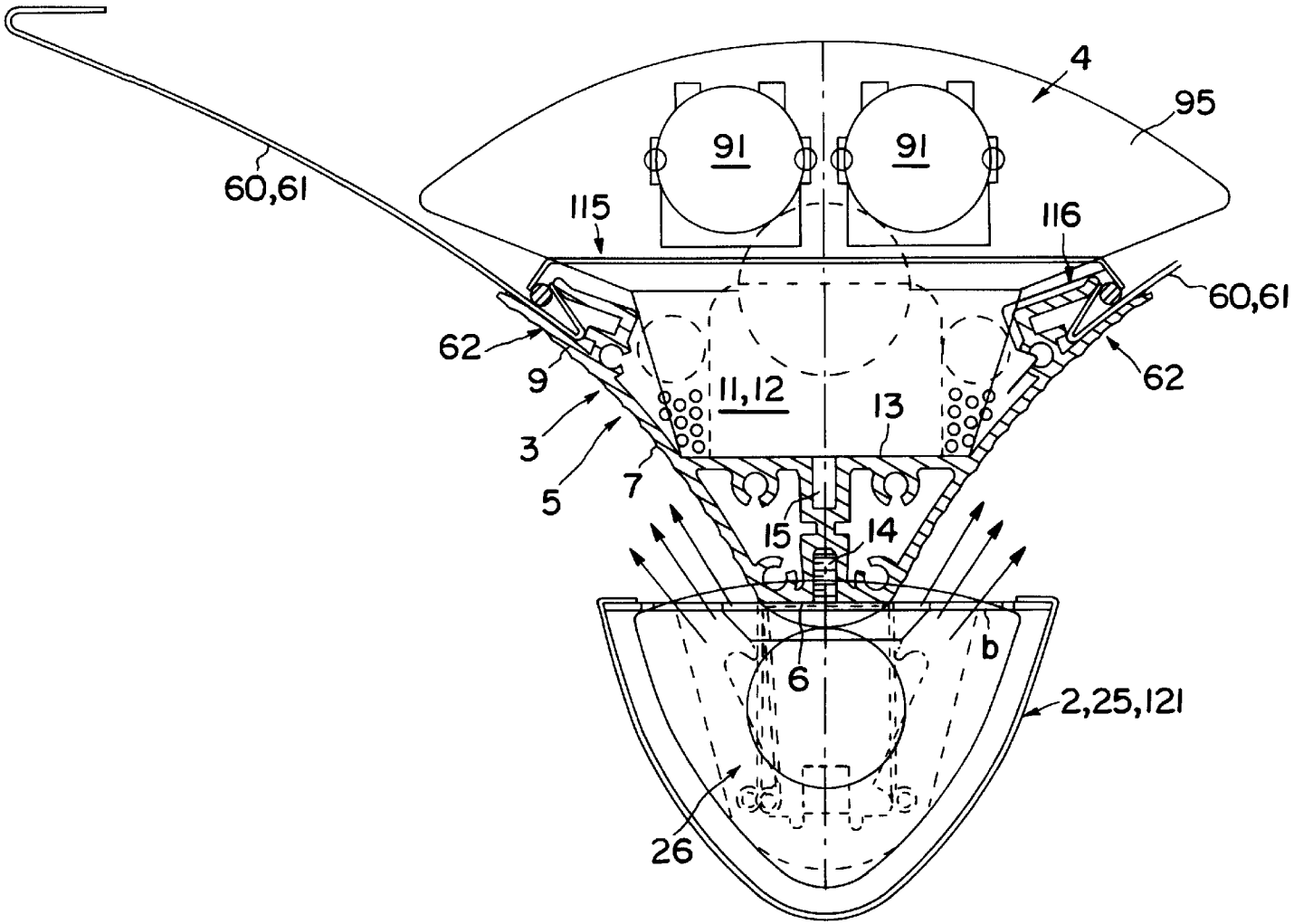
FIG. 8 shows a perspective view of an end portion of the light fitting from inside.

As shown by FIGS. 6 and 8, it is advantageous to stabilise the free edges of the light distribution elements 61 by means of U-shaped rounded or cornered downwards or upwards directing U-bends 112 or bends.

These stabilisation measures are of particular advantage when the light distribution elements 61 are made of thin material, for example, with a thickness of about 1 to 2 mm. In such a case, it is favourable to also form the cross connection portion 111 with the corresponding thickness.

In the case of relatively thin light distribution elements 61, it is favourable to also stabilise these in the region of their inner edge, i.e. in the region where this is connected to the base body 5. In the embodiment according to FIGS. 7 and 8, edge limbs 113 are arranged on the inner edges which extend preferably rounded in a wedge-shape from the free end to the outer edge of the light distribution element 61 in question and enclose in doing so an acute angle W of about 10 to 15°. As a result of this, a stabilised plug foot is formed for the plug-in connection 62. These edge limbs 113 can be bent back or formed into the illustrated position. Despite the thin construction, the thus formed support foot has a width on the free edge of the light distribution element 61 which is adapted to the width of the relevant plug recess 63*a*. The edge limb 113 extends up to the plug opening 63*c* so that the available wedge shape fills the plug opening 63*c*. For further stabilisation, it is favourable to jam a clamped piece 114 with a preferably round cross-section, e.g. a pin or rod-shaped clamped piece 114 between the light distribution element 61 and its edge limb 113 in the region of the plug opening 63*c* with the cross-sectional size of the clamped piece 114 having correspondingly large dimensions. The arrangement can be struck such that the clamped piece 114 remains in its clamped position as a result of its self restraining wedging effect. To secure the clamped piece 114, however, a holding down device 115 can also be provided, the dimensions and shape of which can correspond approximately to the cross connection portion 111, i.e. it has a holding down web 115*a* and side holding down limbs 115*b* with which it secures the clamped pieces 114 positioned on both sides in the clamped position. The holding down device 115 can be attached with a positive fit or by means of screws which pass through it and are screwed into the base body 5 or add on parts of the same (not illustrated).

It is also possible to fix the holding down device 115 or the clamped piece 114 to the base body 5 by means of a quick action connection. According to FIGS. 7 and 8, this can be performed by a C-shaped clamp 116 which is connected, if need be pivotably, to the holding down device 115 or the clamped piece 114 at its base end or is so elastic that it can be latched in a catch recess with a nose 117 arranged in its free end portion. In this embodiment, a clamp 116 is provided in the form of a C-shaped leaf spring which extends C-shaped around the material shoulder 64 and, in its free end region, the latch nose 117 as a wedge-shaped deflection and a lamellar manual engaging element 118 protruding therefrom is bent in one piece for releasing.

Figure 7:
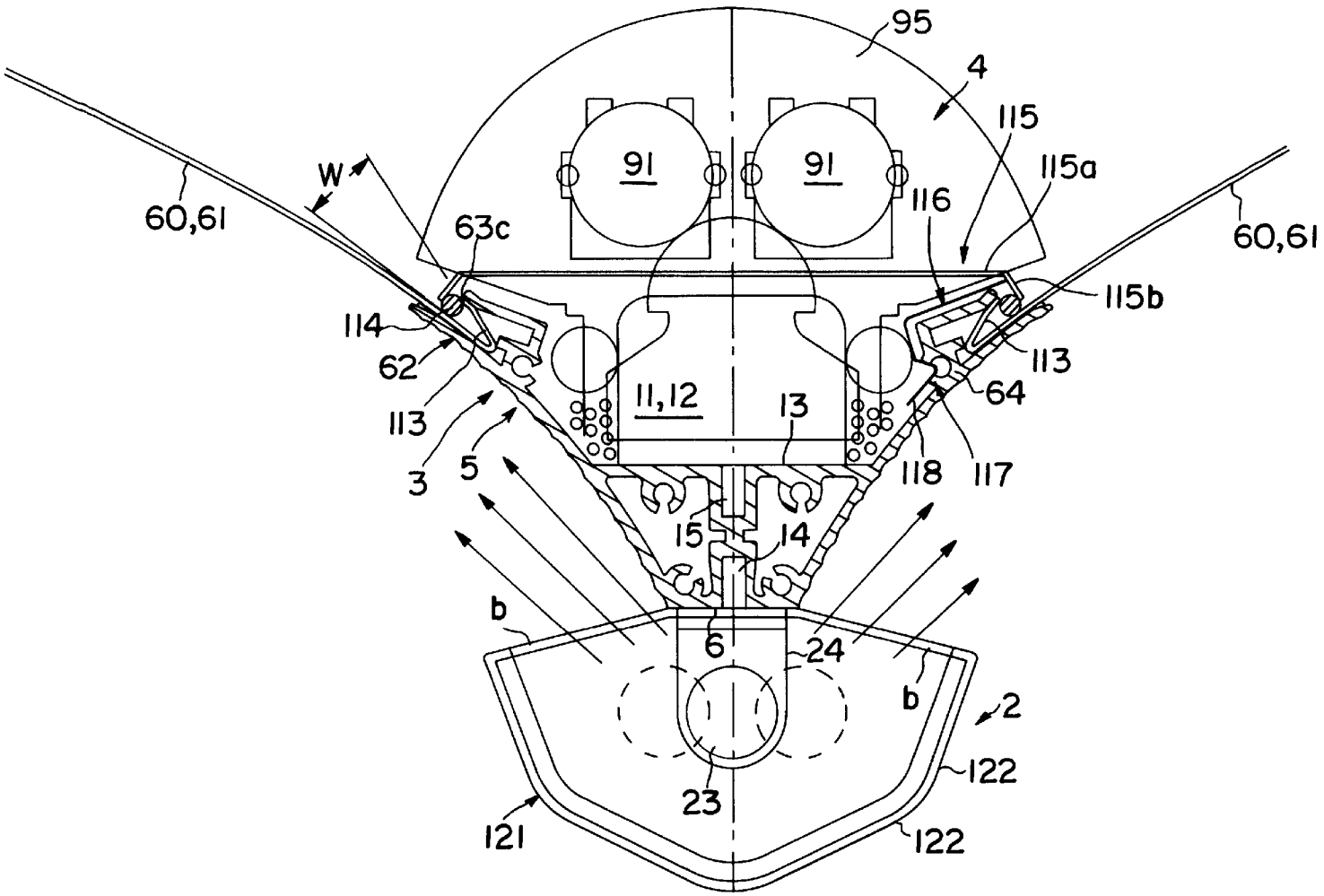
FIG. 7 shows a vertical profile of a light fitting according to the invention in a further modified embodiment.

In the embodiments according to FIGS. 7 and 8, in which identical or similar parts are also given the same reference numbers, the light distribution element 61 has the shape of a trough-shaped basket 121, wherein the cross-sectional shape of the basket can be rounded (FIG. 8) or formed by several, for example four, flanks 122, each enclosing an obtuse angle between them (FIG. 7), with the corners enclosed by the flanks 122 being preferably rounded. The top side of the basket 121 can be horizontal or slanted outwards on both sides. The basket 121 is releasably connected to the base body 5 either directly or by means of the quick fastening connection or latching device 26.

The formation of the light distribution element 61 as a basket 121 is particularly advantageous when the first indirect lighting device 3 is to be apportioned more lighting power. For this, the basket 121 can be formed as a reflector on its inner side which reflects the light rays supplied by the lamp 23 at least partially upwards through the opening in the basket's top side, see gaps b.

It is possible within the context of the invention to vary the lighting power for the direct lighting device 2 and the first indirect lighting device 3 and second lighting device 4. This can be achieved by the reflector 27 or the side reflectors 29 or the inner and outer wall 35, 36, and/or the light distribution elements 61 and/or the basket 121 being made of transparent or translucent and/or perforated walls so that one or the other of the lighting devices 2, 3, 4 can be apportioned more lighting power according to translucency. This also applies to the frontal blends 95 which contribute to indirect lighting, in particular in the front area of the light fitting 1 in a corresponding manner.

In all of the embodiments described above, the light distribution elements 61 can extend either in a straight line or concavely curved, wherein they can form extensions of the contour form of the side surfaces 7 (e.g. FIGS. 7 and 8) or for example can be straight and slightly bent downwards (FIG. 1). The light distribution elements 61 therefore form indirect distribution elements which contribute both to the illumination of the room and to the illumination of the room via the light fitting 1 and do so both when directly mounted on the ceiling 71 and when mounted in suspended form. The above described characteristic is dependent on the design of the light distribution elements 61, namely transparent, translucent and/or perforated. If the light distribution elements 61 have reflector surfaces 61*a* on their under sides which can, for example, be formed by a coating, they form indirect reflectors. These can be simultaneously transparent, translucent and/or perforated for the purpose of lighting the space situated above it.

The side surfaces 7 of the base body 5 can also be reflective (plain or laminated) and form reflector surfaces.

It is also favourable to form the top surface of the cross connection portion 111 or the holding down device 115 as a reflector so that light coming from the lamps is reflected against the ceiling which also contributes to indirectly lighting the ceiling area.

Figure 9:
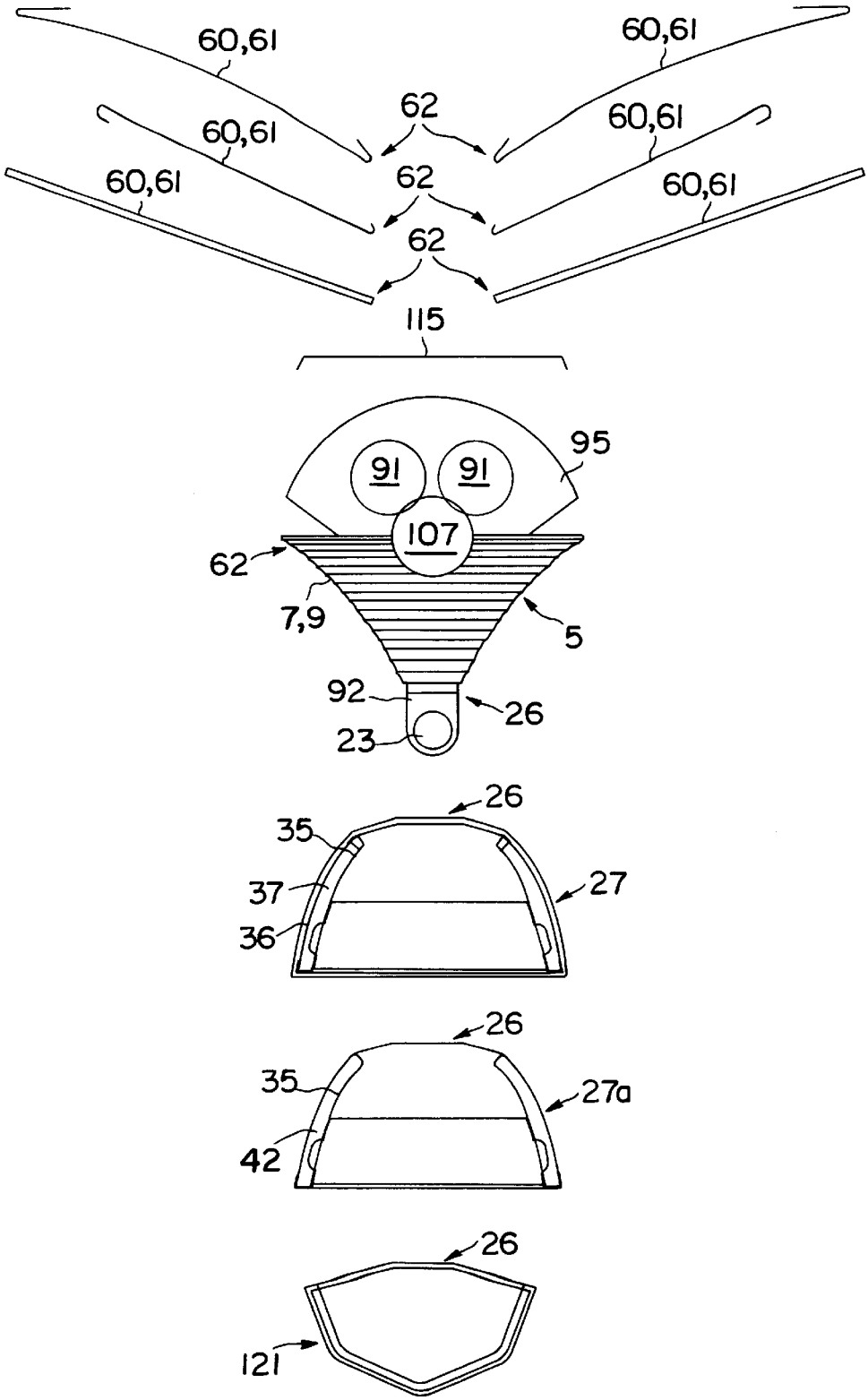
FIG. 9 shows a vertical profile of a light fitting according to the invention in a further modified embodiment.

The illustration of the light fitting 1 according to FIG. 9 is intended to elucidate the possible variations which the embodiments of the invention make possible. It is namely possible to choose whether one and the same base body 5 should be fitted with a light distribution element 61 in the form of a reflector 27 having an inner wall 35 and outer wall 36, a reflector 27*a* having just one inner wall 35 or a basket 121. This also applies to the light distribution elements 61 in the described, various embodiments which can optionally be fixed on the base body 5. This is possible because the respective connection device parts of the aforementioned parts which can be alternatively ad-mounted (light distributor 25, light distribution elements 61) match the relevant connection device parts on the base body 5.

In particular, when the outer walls 36 are not present on the reflector 27*a* in FIG. 9 but also when they are present, it is possible and advantageous for reasons of simplification to form the end caps 42 as flat front walls. It is further advantageous to arrange projecting matching pieces 121*b* on the top surface of the end caps 42, 121*a* or front walls which fit in the lower screw channel 14 for lateral centralisation purposes, as is shown for example in FIG. 5*b*.

Figures 10, 10A:
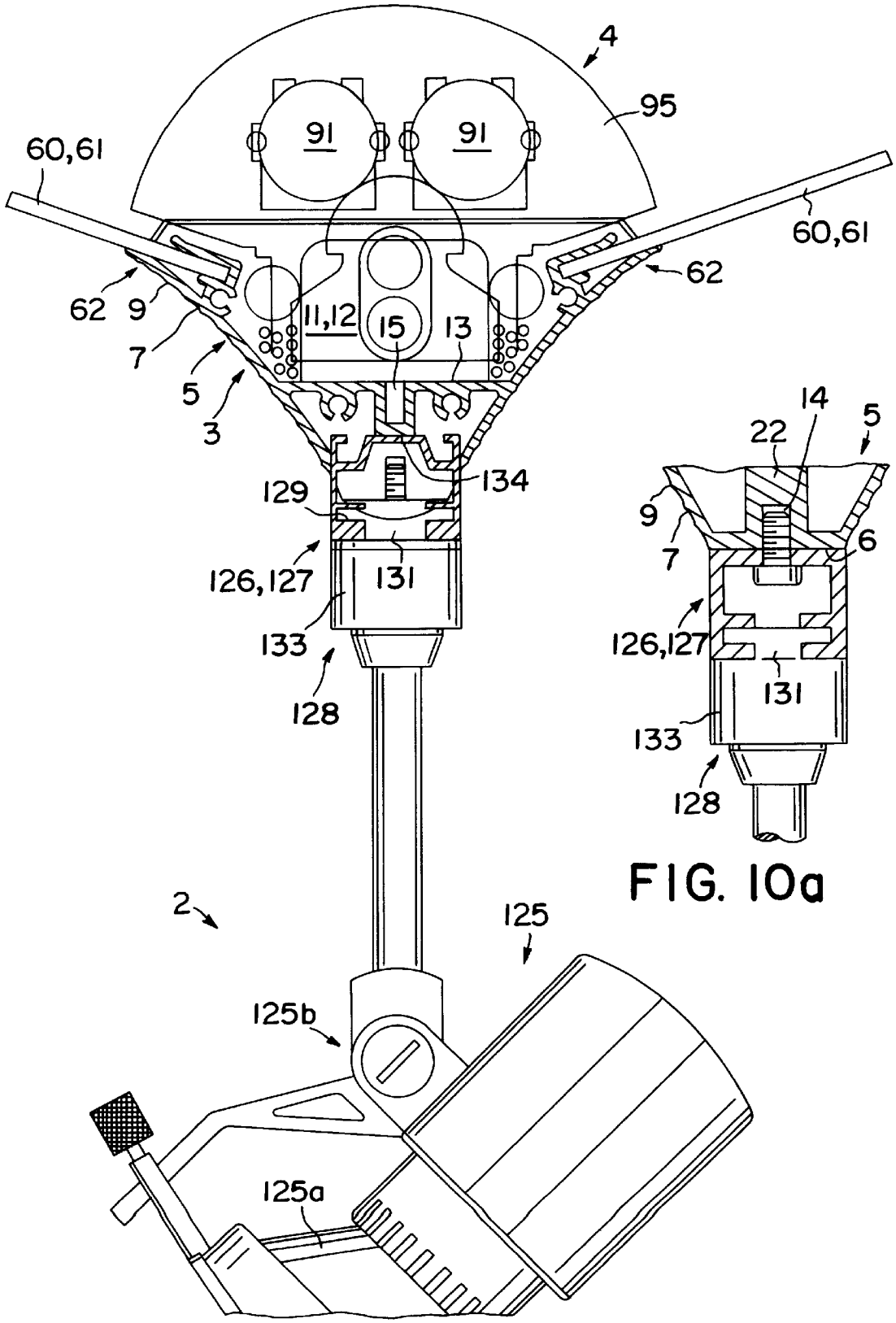
FIG. 10 shows a so-called exploded view of a light fitting according to the invention with a plurality of its main parts to elucidate possible variations.
FIG. 10*a* shows a profile of the light fitting according to FIG. 10 in modified detailed form.

In the embodiment according to FIG. 10, in which the same or similar parts are also given the same reference numbers, the direct lighting device 2 has one or several spotlights 125 which are connected to the lower corner region of the base body 5 preferably by means of a quick fastening connection 126 or a longitudinal sliding guide 127, are preferably movable longitudinally in the sliding guide and can be set by a locking device 128. The sliding guide 127 can span the entire length of the base body 5 or just a partial area of the same wherein several slides 127 can be arranged lengthways behind each other.

As shown by FIG. 10, the sliding guide 127 is formed by a guide profile 128 having undercut guide surfaces 129 on which a guide block 132 bearing the spotlight 125 is guided, held and displaceable. The respective setting of the locking device can, for example, be performed by a manually actuable screw part 133.

The guide section 128 can be achieved on the lower mounting surface 6 or on a special mounting surface 134 which can be formed by a recess on the bottom side, e.g. a countersinking. In the present embodiment, the mounting surface 134 is located between the two screw channels 14, 15.

The spot head 125*a* of the spotlight is preferably pivotable and arranged locked into the respective pivoted position by means of a locking device 125*b*.

For connecting the at least one spotlight 125 to the electric power supply, conductor rails for the electric power circuit (not illustrated) can be allocated to the fixing foot or the guide section 128 which are connected to power collectors (contacts or sliding contacts) of the power circuit.

It is possible and advantageous within the boundaries of the invention to use the indirect reflectors 60 and/or the outer surfaces of the reflector 27 as advertising space for advertisements.

Figure 12:
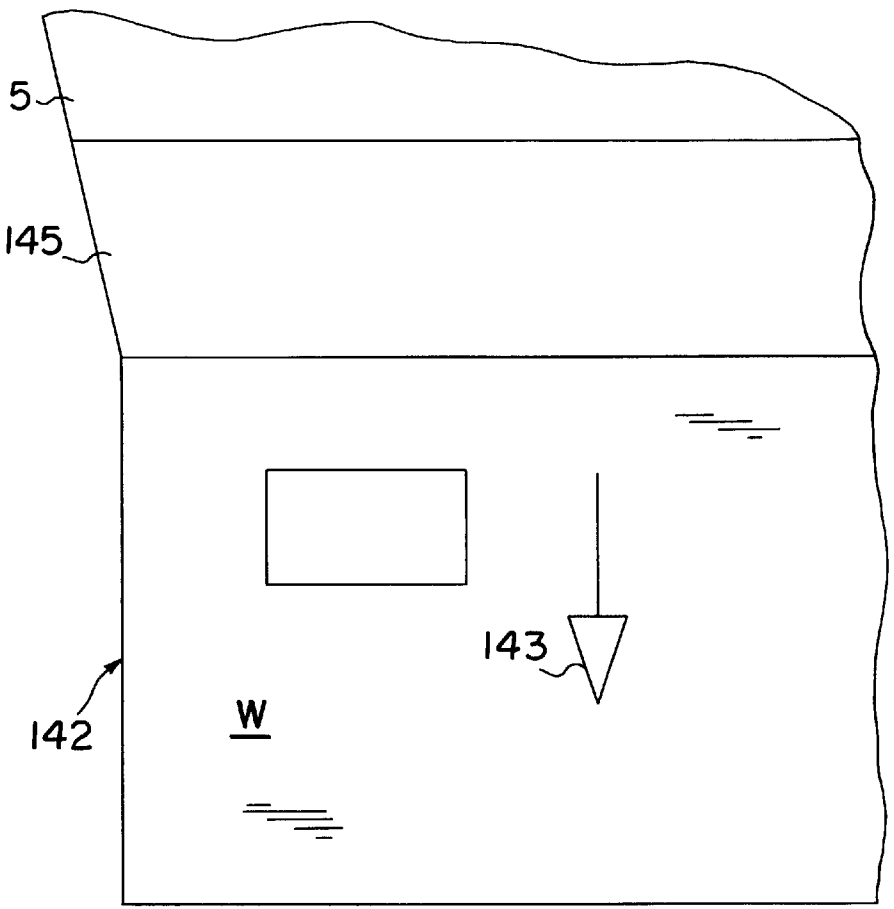
FIG. 12 shows the side view of the light fitting according to FIG. 11.
Figure 11:
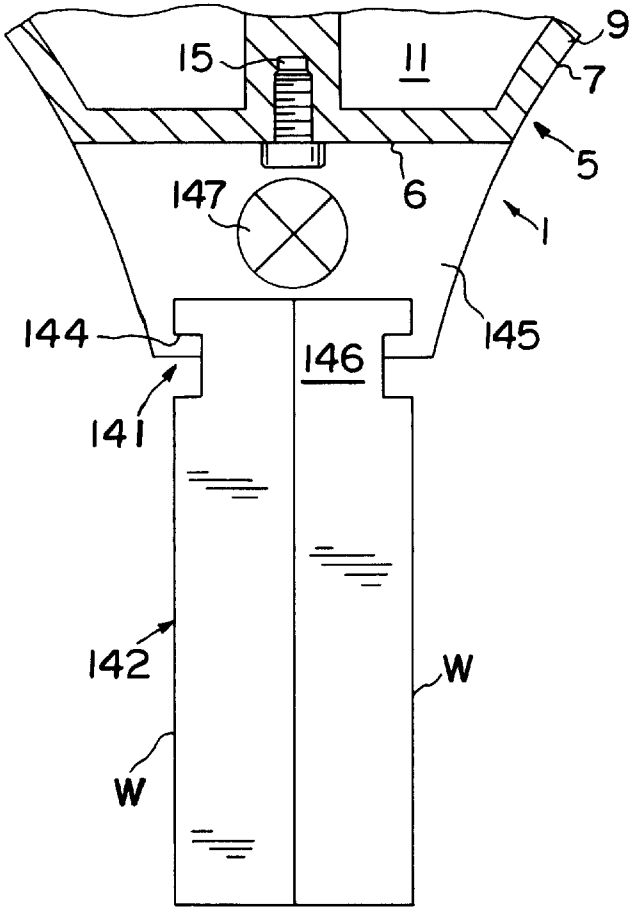
FIG. 11 shows the front view of a light fitting according to the invention in a further modified embodiment.

In the embodiment according to FIGS. 11 and 12, in which identical or similar parts are given the same reference numbers, a fixing means 141 for a board 142 or the like, also preferably formed by a quick fastening connection or plug-in connection is arranged in the lower corner region of the base body 5, on the side surfaces of which area advertising space for advertisements or bearing surfaces for written or drawn notes, e.g. directional arrow 143 and/or words such as emergency exit are applied. This embodiment is advantageous because the advertising or bearing area can be provided in a highly visible position underneath the light fitting 1 on the one hand and is lit up by the light fitting 1 on the other.

As shown by FIGS. 11 and 12, the fixing device 141 for example can be formed by a sliding guide, in particular by a guide notch 144 of a guide rail 145 into which a correspondingly formed holding foot 146 of the board is pushed and positively locked. The guide rail 145 can also be formed as a lamp housing with a lamp 147 for illuminating the board 142.

It is also possible to arrange two boards next to each other, each of which have the advertising area or bearing area on their outer surfaces. It is advantageous to make the at least one board 142 out of transparent or translucent material, preferably plastic.

It is also possible within the framework of the invention to form the light fitting not extending in a straight line but, for example, round (rotation profile).

What is claimed is:

1. A light fitting having an elongated profile-shaped base body, said base body comprising:

a fastener for mounting said light fitting;

two lateral body walls arranged to enclose a trough-like space having a generally triangular cross-sectional form;

said body walls converging towards a side of said base body opposite to said fastener;

said body walls also converging on a flattened area of said body walls which forms a first mounting surface for mounting add-on parts to said base body; and mountings on said base body for mounting at least one lamp and said operating device, said mounting for said at least one lamp being located on a side of said base body facing said fastener.

2. A light fitting according to claim 1, wherein an electric operating means for said light fitting is accommodated in said trough-like space of said base body.

3. A light fitting according to claim 1, wherein said body walls are concavely curved.

4. A light fitting according to claim 1, wherein said base body is extruded from a material chosen from the group consisting of aluminum and plastic.

5. A light fitting according to claim 1, wherein said mounting surface is level.

6. A light fitting according to claim 1, wherein said base body has a second mounting surface which is accessible from said side facing said fastener.

7. A light fitting according to claim 6, wherein said second mounting surface is located at the bottom of said trough-like space.

8. A light fitting according to claim 1, wherein the first mounting surface is arranged at the bottom of said trough-like space.

9. A light fitting according to claim 1, wherein holding means for a light distributor are arranged on said first mounting surface.

10. A light fitting according to claim 1, wherein holding means for a lamp are arranged on said first mounting surface.

11. A light fitting according to claim 1, wherein said light fitting has a light distribution element on at least one side of said base body, said light distribution element extending in a wing-shaped manner from said base body, and wherein said light fitting further includes a quick-fastening connection into which the light distribution element is insertable and held.

12. A light fitting according to claim 11, wherein said quick-fastening connection is a plug-in connection and is arranged in a corner region of a side of said base body facing said fastener.

13. A light fitting according to claim 12, wherein said plug-in connection is formed by a plug recess into which a light distribution element may be inserted.

14. A light fitting according to claim 13, wherein said plug recess extends diagonally to the side of said base body facing said fastener.

15. A light fitting according to claim 13 or 14, wherein said plug recess comprises a common plug opening which contains two plug recess sections, each recess section being constructed to accommodate a plug from a separate light distribution element.

16. A light fitting according to claim 15, wherein a light distributor holder is arranged on said first mounting surface, and a holder for at least one laterally projecting light distribution element is located in a region of said base body facing said fastener, whereby a light distribution element, which may be chosen from a plurality of various light distribution elements, can be mounted on said base body.

17. A light fitting according to claim 16, wherein said holders are quick fastening latch connectors.

18. A light fitting according to claim 1, wherein a light distributor holder is arranged on said first mounting surface, and a holder for at least one laterally projecting light distribution element is located in a region of said base body facing said fastener, whereby a light distribution element, which may be chosen from a plurality of various light distribution elements, can be mounted on said base body.

19. A light fitting according to claim 18, wherein said holders are quick fastening latch connectors.

20. A light fitting according to claim 1, wherein said fastener is arranged on said base body at a location such that it is accessible at the side of said base body facing the ceiling or the wall, said fastener being arranged within the width of said base body and directly engaging said base body.

21. A light fitting according to claim 1, wherein an operating device is arranged in said trough-like space, said trough-like space being larger than said operating device, and wherein and a screw channel extends in the longitudinal direction of the base body and is disposed in said first mounting surface.

22. A light fitting having a profiled base body extending in a straight line and bearing at least one lamp, an operating device and being formed to bear optional light distributors, said light fitting including a fastener for fastening the fitting to a ceiling or a wall, said base body being formed with two lateral body walls which enclose a trough-like space having a generally triangular cross-sectional form, said body walls converging towards a side of said base body facing away from the fastener, said trough-like space being larger than the operating device and the latter being arranged therein, said lateral body walls converging toward a flattened area of said body walls which forms a first mounting surface for add on parts of the base body, and said base body being formed with a screw channel extending in the longitudinal direction thereof and disposed in said first mounting surface.

* * * * *